US005800247A

United States Patent [19]

Harms

[11] Patent Number: 5,800,247

[45] Date of Patent: Sep. 1, 1998

[54] NON-CONTACT GAGING APPARATUS AND METHOD

[75] Inventor: Michael J. Harms, Dow, Ill.

[73] Assignee: Centerline Engineering, Inc., Jerseyville, Ill.

[21] Appl. No.: 844,727

[22] Filed: Apr. 18, 1997

Related U.S. Application Data

[60] Provisional application No. 60/015,670, Apr. 19, 1996.

[51] Int. Cl.[6] ..... B24B 49/04

[52] U.S. Cl. ..... 451/5; 451/9; 451/142; 451/407; 364/474.37; 364/551.02

[58] Field of Search ..... 451/5, 8, 9, 407, 451/142; 364/474.37, 474.06, 551.02

[56] References Cited

U.S. PATENT DOCUMENTS

| | | | |
|---|---|---|---|
| 2,481,993 | 9/1949 | Fuss | 175/320 |
| 3,060,421 | 10/1962 | Rideout | 343/5 |
| 3,258,688 | 6/1966 | Augustine | 324/58.5 |
| 3,490,037 | 1/1970 | Williams | 324/58.5 |
| 3,514,703 | 5/1970 | Soga | 324/58.5 R |
| 3,651,605 | 3/1972 | Title | 451/142 |
| 4,045,727 | 8/1977 | Yu et al. | 324/58.5 B |
| 4,053,237 | 10/1977 | Casey | 356/209 |
| 4,366,543 | 12/1982 | Feller et al. | 364/474.37 |
| 4,501,095 | 2/1985 | Drinkuth et al. | 51/165.72 |
| 4,509,295 | 4/1985 | Bottcher et al. | 51/49 |
| 4,516,212 | 5/1985 | Nagashima | 451/5 |
| 4,524,546 | 6/1985 | Hoover et al. | 451/142 |
| 4,623,835 | 11/1986 | Mehdizadeh et al. | 324/58.5 R |
| 4,827,751 | 5/1989 | Holthoff | 364/474.37 |
| 4,912,884 | 4/1990 | Sigg | 451/9 |
| 5,213,348 | 5/1993 | Crossman et al. | 451/407 |
| 5,371,975 | 12/1994 | Lundmark | 451/9 |

*Primary Examiner*—Robert A. Rose
*Assistant Examiner*—George Nguyen
*Attorney, Agent, or Firm*—Herzog, Crebs and McGhee, LLP

[57] ABSTRACT

An apparatus for non-contact gauging in precision machining, which comprises a sensor arm, a sensor head, a display device, a data entry device, a rotary encoder, and positioning device. The sensor head has a coarse contact sensor and a fine non-contact sensor for initial positioning and precision control, respectively.

10 Claims, 6 Drawing Sheets

NON-CONTACT GAGING APPARATUS AND METHOD

This application is a continuation-in-part of provisional application Ser. No. 60/015,670 filed Apr. 19, 1996.

BACKGROUND OF THE INVENTION

1. Field of the Invention

This invention relates to methods of gaging rolls during surface profile altering operations and apparatus for performing the method, such as precision abrading processes with indication of workpiece surface location.

2. Related Art

When machining or grinding rolls to a desired shape, it is necessary to conduct measurements to determine when the desired shape has been achieved. For grinding operations on metalworking rolls, the customary method in current use is to have caliper type gages in contact with the surface of the roll being machined, to thereby measure diameter of the roll as it is being machined. The contact between the sensor and the roll results in wear and vibrations which limit sensor life, limits accuracy of the readings and this limits the accuracy of the grinding process. In other more sophisticated machine-working methods for rolls, non-contact measurement of roll profile is suggested but without indication of how such measurement is accomplished, particularly as respects how the sensor is initially positioned relative to rolls of various sizes and how working fluids are prevented from interfering with the measurements.

Consequently, there is a need for a non-contact gauging system for surface profile altering devices for use in precision machining of rolls and the like which can be rapidly and accurately positioned and which will have increased accuracy of measurement.

SUMMARY OF THE INVENTION

It is in view of the above problems and the unavailability of a device reliably solving the above problems that the present invention was developed. The invention comprises an apparatus for non-contact gauging in precision machining, which comprises a sensor arm, a sensor head, a display device, a data entry device, a rotary encoder, and positioning device. The sensor head has a coarse sensor head and a fine sensor head for initial positioning and precision control, respectively.

It is an object of the invention to provide a non-contact gauging device capable of precision control of machine grinding operations.

It is a further object of the invention to provide a non-contact gauging device with a sensor head having means for initial positioning using contact probes.

It is a further object of the invention to provide a means for cleaning working fluids from between the gauge and the workpiece being measured.

BRIEF DESCRIPTION OF THE DRAWINGS

The advantages of this invention will be better understood by referring to the accompanying drawing, in which.

DESCRIPTION OF THE PREFERRED EMBODIMENTS

A three axis Cartesian coordinate system will be used in describing the invention. The "x-axis" refers to the lateral direction, "y-axis" to the front to rear axis and the "z-axis" as the vertical, with the positive directions being right, forward and up, respectively, as is customary in geometry. Unless otherwise indicated, these will be with reference to point 75 on the non-contact sensor as seen in FIG. 4.

Figure 7:
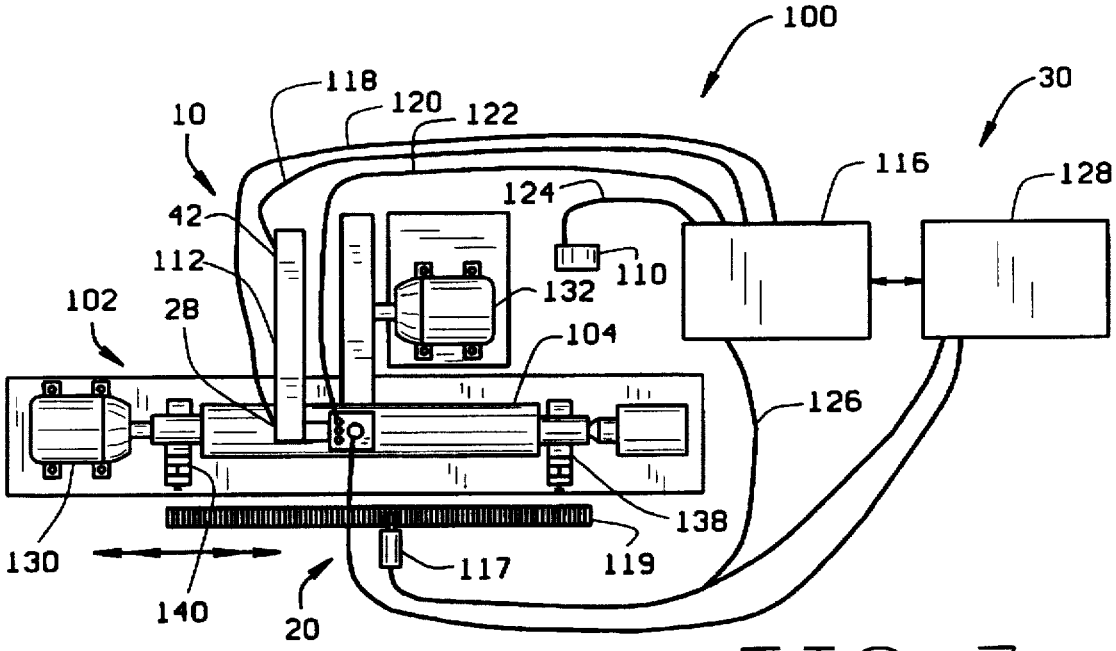
FIG. 7 is a diagram of the electrical connections of the sensor arm of FIG. 1 and an encoder rack with a computer.

Referring first to FIG. 7, the non-contact gauging system 100 is shown in place on a roll grinding machine. The roll grinding machine 102 does not form part of the invention, but is typical of the devices which can be monitored by use of the system 100. The non-contact gauging system comprises a sensor arm 10, an encoder 20 and a programmable computer 30, and connecting wiring 40, each of which will be described in detail below. In the application shown in FIG. 7, the system 100 is used to monitor the grinding of a roll 104 in machine 102 to increase the frequency, accuracy and reliability of the measurement of roll diameter during grinding.

Figure 2:
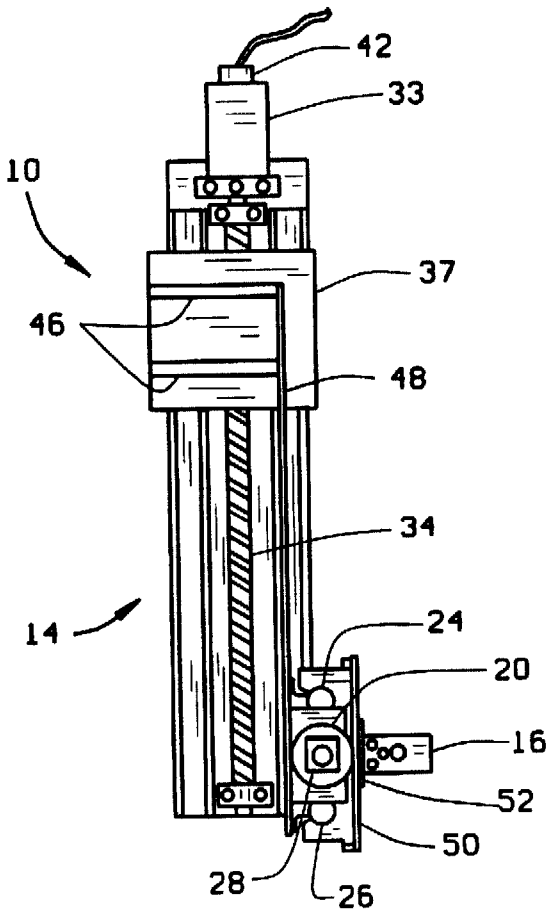
FIG.2 is a top view of the sensor arm of FIG. 1.
Figure 1:
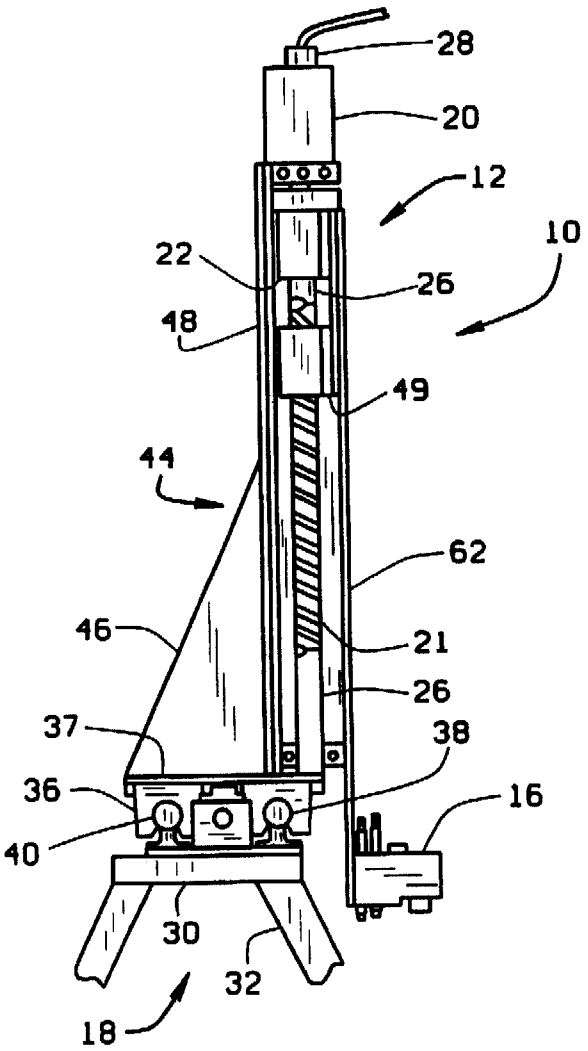
FIG. 1 is a front elevational view of a sensor arm embodying a preferred form of the invention.
Figure 8:
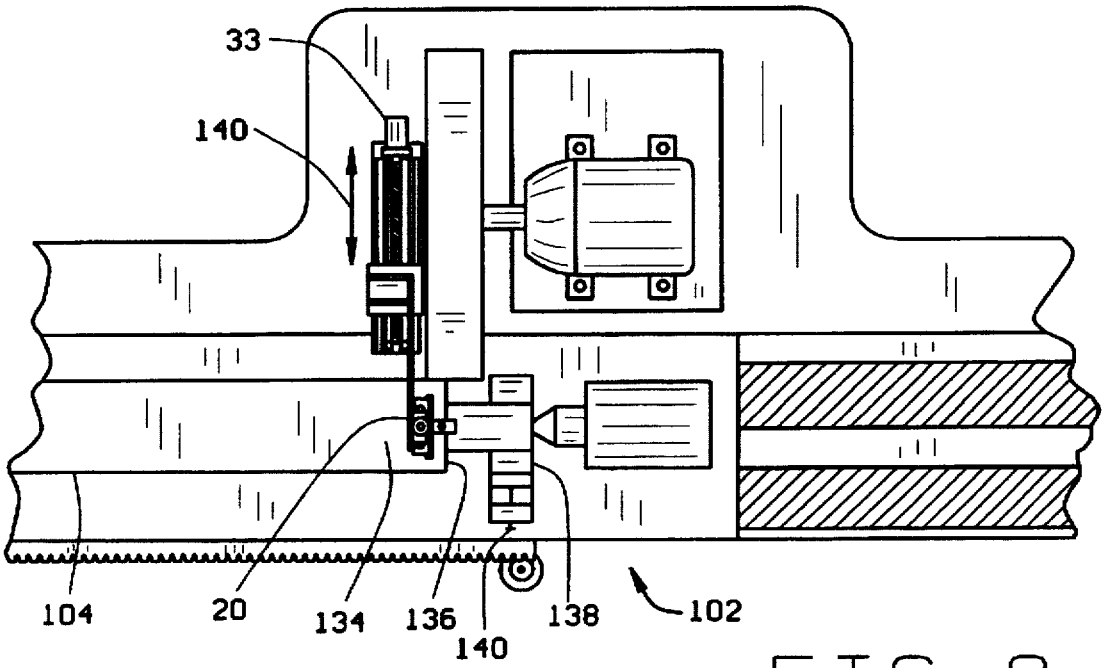
FIG. 8 is a top view of a the sensor arm of FIG. 1 on a grinding machine in a position to determine the location of the right end of a roll to be ground therein.

Referring next to FIG. 1 and FIG. 2, the sensor arm 10 comprises a vertical rail drive system 12, a horizontal rail drive system 14, a sensor head 16, and a rigid support stand 18. Vertical rail drive system 12 includes a servo or stepper motor 20, a ball screw 21, a follower 22, a nut 49 and a pair of vertical rails 24, 26 and a rotary encoder 28. Sensor head 16 will be explained below. Horizontal rail system 14 similarly comprises a servo or stepper motor 32, a ball screw 34, a follower 36, a pair of horizontal rails 38, 40, and a rotary encoder 42. The encoders 28, 42 have a resolution of 4,096 pulses per revolution. The balls screws 21, 34 have a lead of 0.1" per revolution. Thus for each pulse from encoder 28, 42 there would be a linear movement of 0.0000244" in the vertical or horizontal direction, respectively. However, any suitable number of pulses may be employed depending on the accuracy desired. Support stand 18 includes a horizontal platform 30, a suitable number of legs 32, a secondary platform 43, a pair of lateral vertical support plates 46, a forwardly extending horizontal support plate 48, a vertical platform 50, and a vertical support bar 52. Support stand 18 is sized and constructed suitably for attachment to a grinding machine, such as the grinding machine 102 of FIGS. 7–9 or other machine with which the non-contact gauging system is to be used, depending on the shape and size of such machine, so the shape and size of the various parts of the support stand would be altered as needed to fit a particular machine. The legs 32 rigidly support horizontal platform 30 upon which is mounted the horizontal rail system 14. Rail system 14 causes forward and rearward movement of the sensor head 16. Follower 36 is engaged with ball screw 34, rides on rails 38 and 40 and is rigidly attached to and supports secondary platform 37, upon which vertical rail system 12 is mounted. Follower 36 moves forward or rearward in response to rotation of screw 34, depending on which direction screw 34 is rotated. Vertical lateral plate 46 and forwardly extending support plate 48 are rigidly affixed to platform 37 and each other and rail system 12 is mounted on plate 48. Rail system 12 causes upward and downward movement of the sensor head 16. Specifically, vertical rails 24, 26 are rigidly attached to plate 48 and follower 22 is slidably engaged with rails 24 and 26. Likewise a nut 49 is engaged with screw 21 to move platform 50, vertical bar 52 and head 16 up or down depending on the direction screw 21 is rotated. The nut 49 could be integral with 22 if desired, but is shown separate in FIG. 1 for clarity. Rail 26 is shown partially cut away in FIG. 1 for purposes of showing the location of screw 21, which would be otherwise hidden from view by rail 26.

Figure 4:
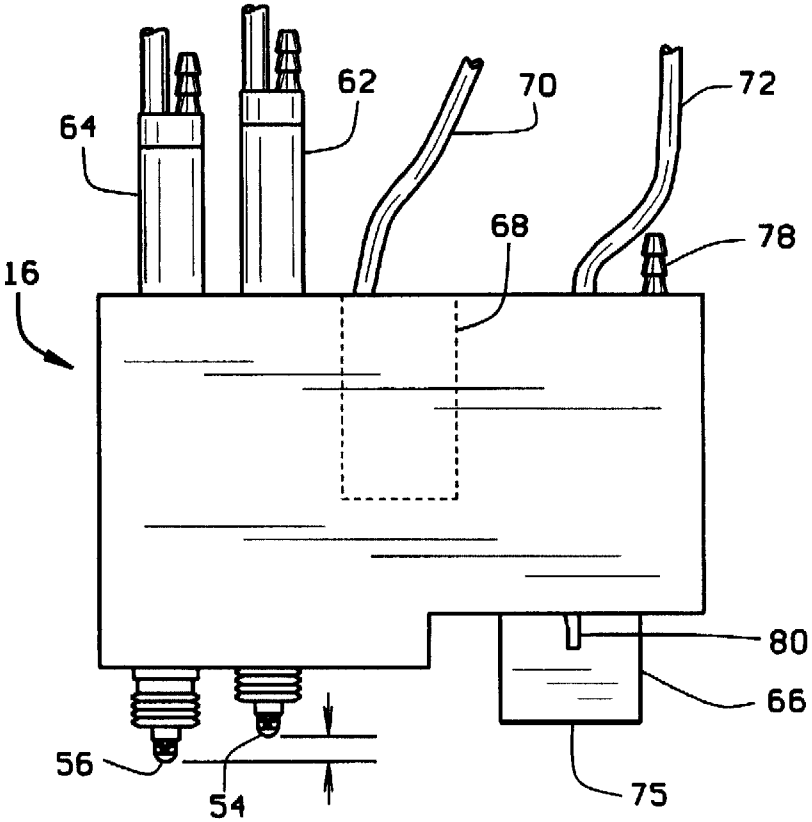
FIG. 4 is a front view of the sensor head of FIG. 3.
Figure 3:
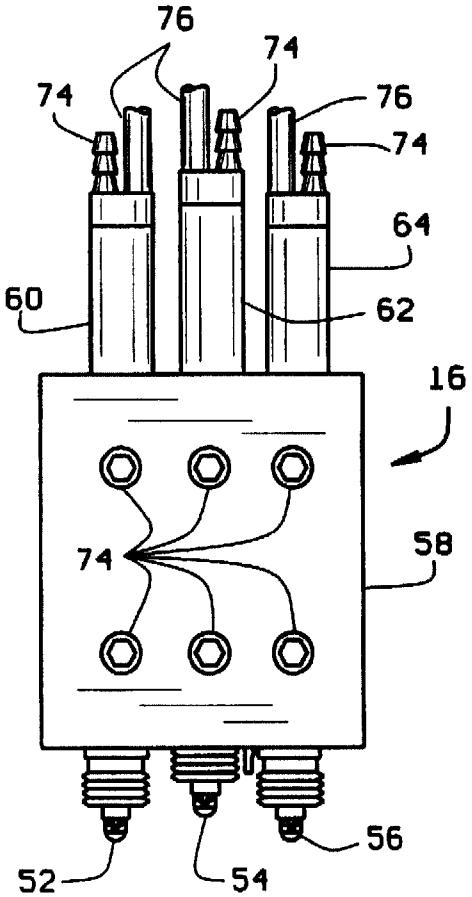
FIG. 3 is a right side view of the sensor head of FIG. 1.
Figure 5:
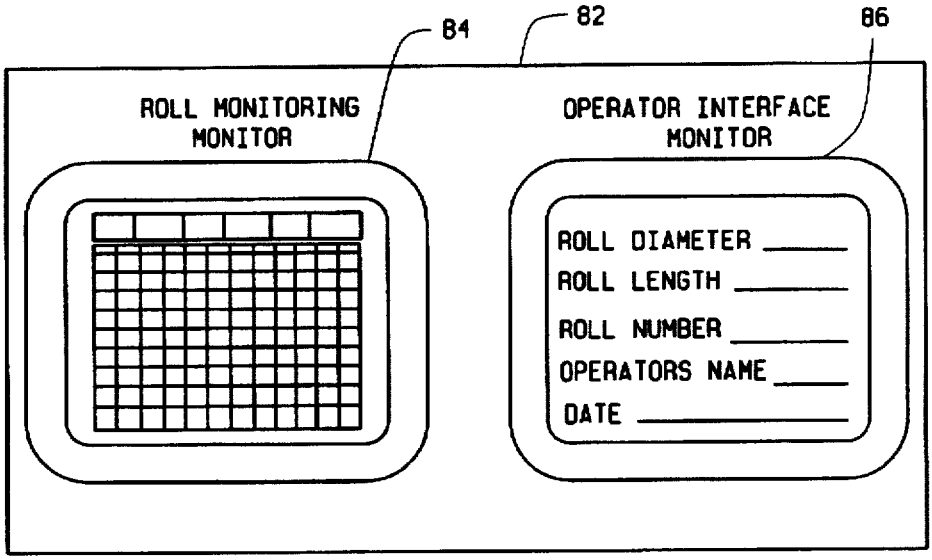
FIG. 5 is a view of a typical computer console of the non-contact gauging system of the invention.

Referring now to FIG. 3 and FIG. 4, sensor head 16 is shown in greater detail. Sensor head 16 comprises front, center and rear contact probes 53, 54, 55; a sensor head body 58, three sensor connectors 60, 62, 64; a non-contact sensor 66; a linear actuator 68, an actuator lead 70, an air inlet 78, an air outlet 80 and a non-contact sensor lead 72. Also shown are six optional locking bolts 74 to allow removal of the probes from head body. These probes could be Solartron Model PDP probes available commercially from Solartron Metrology of Buffalo, N.Y., which are capable of measuring at the rate of 240 measurement per second. Adapters 60, 62 and 64 each contain a pneumatic inlet 74 and an electrical lead 76. The electrical leads would connect to the computer 30 as described below in reference to FIG. 7. The front and rear probes 53, 55 are aligned along the y-axis of the sensor head, while the center sensor 54 is offset in the +x direction of the non-contact sensor 66. The three probes are extendible in response to pneumatic pressure in inlets 74 and provide linear position information in the form of signals through electrical leads 76. Non-contact sensor 66 is preferably a reflected light distance measuring device.

The air inlet 78 and air outlet 80 serve to allow air to be blown against a workpiece being measured to clear working fluids from in front of non-contact sensor 66 to minimize the effects, if any, of the working fluid upon the measurements made by sensor 66. The outlet 80 would therefore be preferably place on the y-axis of the head 16 immediately in front of the non-contact sensor, although other locations might prove equally effective in practice, and thus could be substituted. The linear actuator 68 would serve to extend or retract non-contact sensor 66 in the manner described below.

Figure 6:
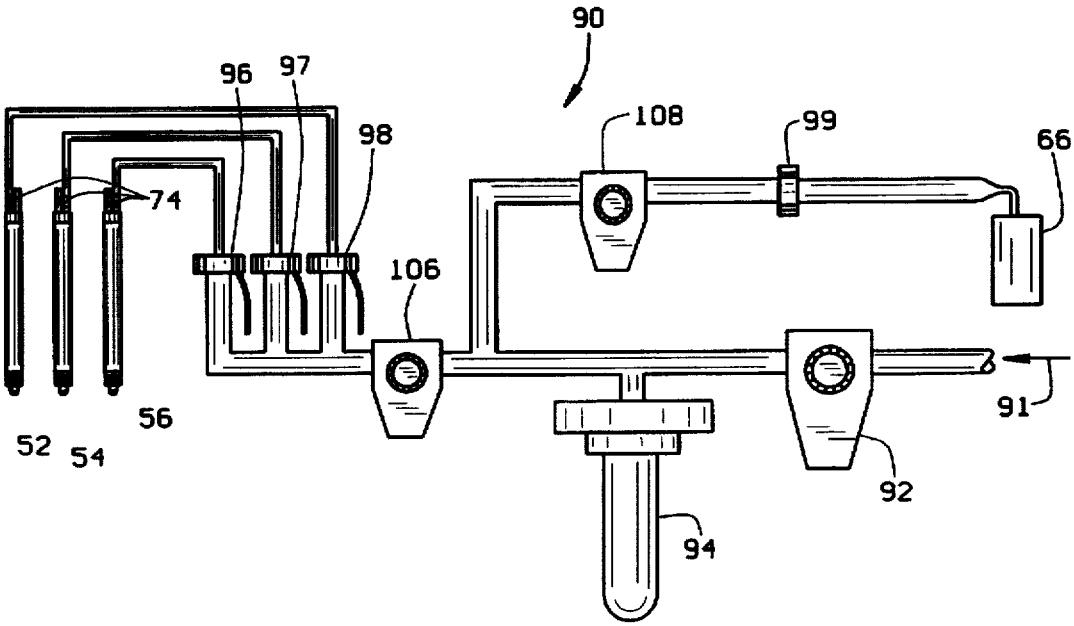
FIG. 6 is a schematic representation of pneumatic system used to control the sensor arm of FIG. 1.

The input and output data from sensor arm 10 is shown on a computer monitor such as computer monitors 84, 86 of console 82 shown in FIG. 6. Monitor 84 shows roll profile as calculated by the computer from the sensor input information, while monitor 86 shows data input by the operator. In operation, it would be expected that a single computer monitor would be used with suitable programming to allow switching between images, or with suitable programming to allow windows showing the input data and calculated data without having to switch images. Such display technology is readily available with routine conventional programming.

Referring to FIG. 6, the pneumatic system 90 of the sensor arm will now be described. Pneumatic system 90 comprises an air supply 91 main regulator 92, air dryer 94, four solenoid valves 96–99, two secondary regulators 106, 108, and connecting passageways. The overall pressure of the pneumatic system is set by regulator 92. Regulator 106 sets the pressure of the air supply to the three contact probes and regulator 108 sets the pressure to the non-contact sensor, which may be different as that air pressure is used to clear working fluids from the small gap between the non-contact sensor and the workpiece. The air supply to the probes and non-contact sensor can be individually turned on or off by solenoid valves 96–99, as appropriate to operation of the system.

The electrical connection of the system 100 will now be described with reference to FIG. 7. A primary computer 116 is connected to the y-axis encoder 42, the z-axis encoder 28, the contact probes 53–55, the solenoid valves 96–99 and an x-axis encoder 117 by electrical leads 118, 120, 122, 124 and 126, respectively. The non-contact sensor 66 is connected to a secondary computer 128, which could be incorporated into computer 116, but is shown separately for better understanding. Also seen in FIG. 7 are motors 130 and 132 which control the operation of the grinding machine and grinding wheel, respectively of grinding machine 100, and which are not part of the invention but rather are only shown as part of an exemplary machine with which the non-contact gauging system of the invention could be advantageously used. The secondary computer 128 would be connected to the primary computer by a suitable communication link 134, to allow calculated distance measurement data to be provided to the main computer 116 based on data received by the secondary computer from the non-contact sensor 66.

Referring further to FIG. 7, the rotary encoder 117 for the x-axis would include a rack 119 to allow the system 100 to know where it is along the x-axis of the workpiece. A gear with a pitch of 1.987" has been found suitable for the encoder 117 and rack 119, with the encoder having a resolution of 256 pulses per revolution, or 0.0242" per pulse.

Figure 9:
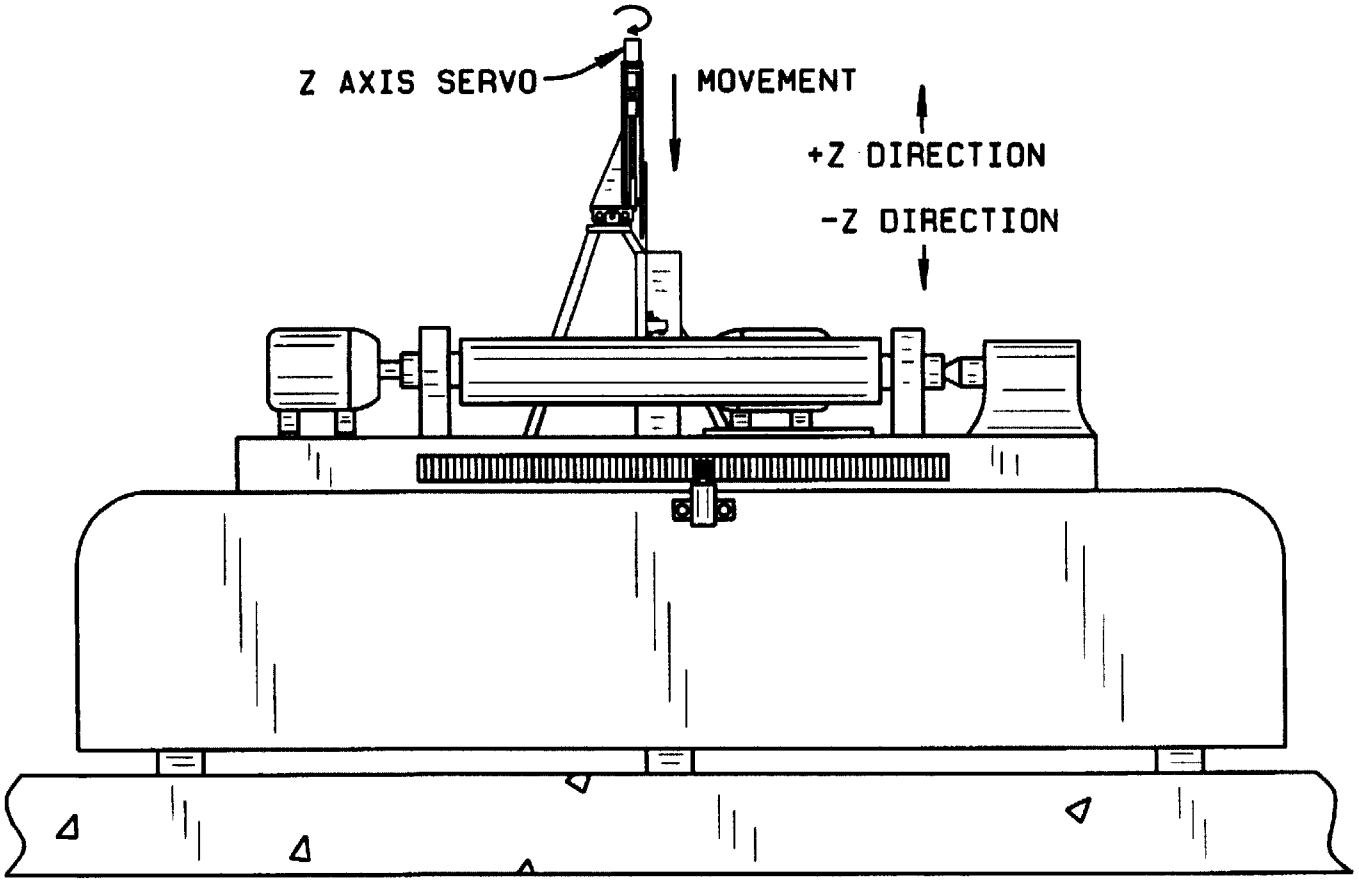
FIG. 9 is a front elevational view of the sensor arm of FIG. 1 on the grinding machine of FIG. 8 in a position to locate the centerline or zenith of the roll to be ground.
Figures 10, 10A, 10B, 10C:
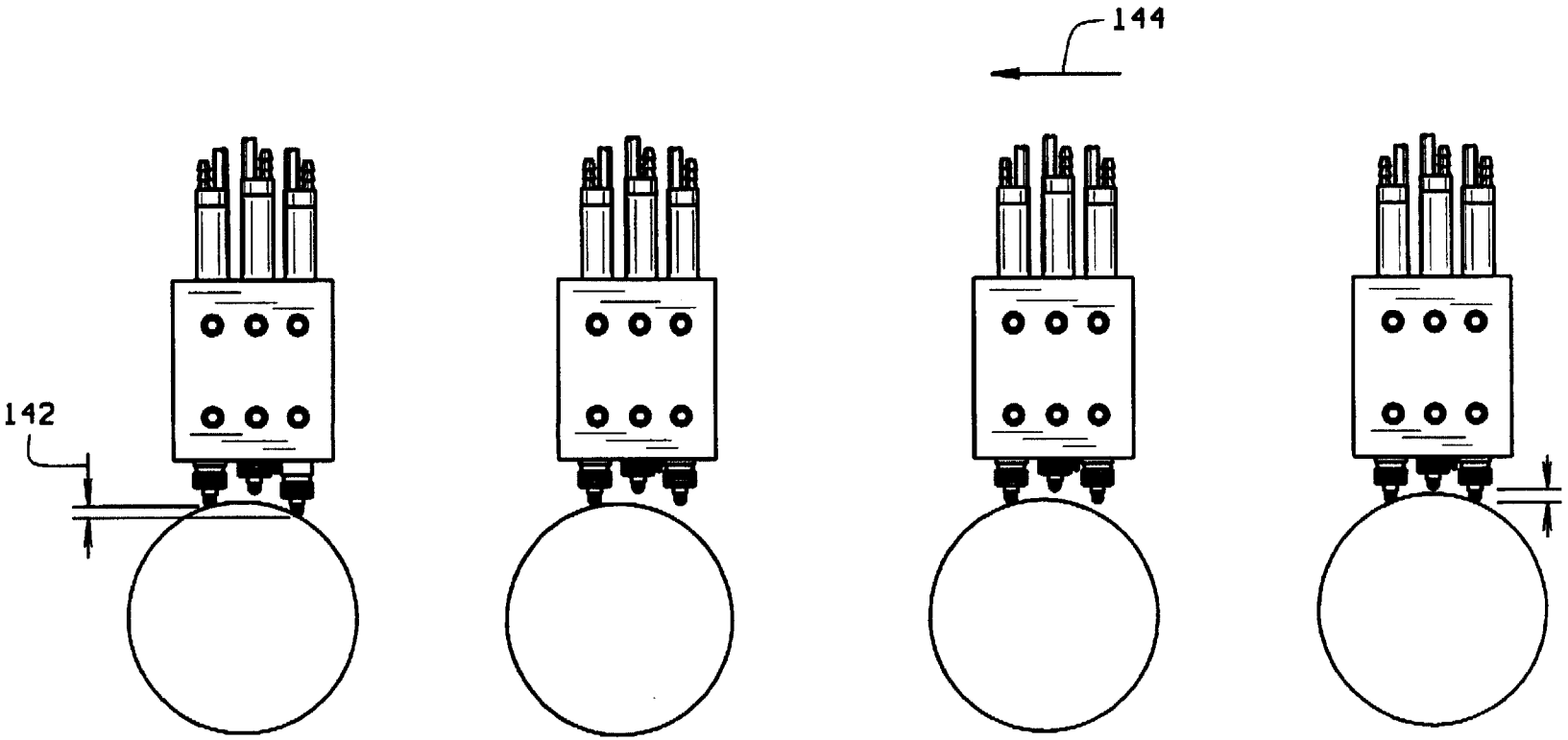
FIGS. 10, 10A, 10B, and 10C are side views of the sensor head of FIG. 3, in each of a series of four sequential positions used in determining the centerline or zenith of a roll to be ground.

The initial set-up of a grinding machine by the use of the system will now be described with reference to FIGS. 7–10. A machine operator will place a roller 104 into the roll grinding machine 102, supported on the journal rests 136. The operator will then input into computer 116 the size of the roll, such as 4.5000" diameter, 48" long (or other length and diameter.) This allows the servo motors 20, 33 to know approximately in the y-axis 140 using servo motor 33, as shown in FIG. 9, and in the z-axis using motor 20 where to position the sensor head 16 to place it approximately 0.15" from the theoretical zenith of the upper surface of the roll adjacent one end of the roll. Probes 53 and 55 will travel vertically down in to "feel" the upper surface 134 of the roller adjacent one end 136 of the roller. If contact is not established, the sensor head 16 will be moved an additional 0.05" in the −z direction (down) and probes 53 and 55 again extended. This is repeated until contact is established. The head 16 will adjust itself in the manner shown in FIG. 10 horizontally so that the middle contact gage 54 is at the zenith of the roll (at that end). This is done by measuring the "delta z" 142 between probes 53 and 55, retracting the probes, moving the head 16 a calculated distance in the ±y direction 144 toward the probe measuring a higher surface (smaller probe length), extending the probes again, remeasuring and again moving the head 16 in the ±y direction 144 toward the probe measuring a higher surface (smaller probe length.) The process repeats until the probes measure equal length. The head 16 will than move along the longitudinal axis to the other end of the roller. Since this can be done starting at either end, both operations are described with reference to the right end of the roll, although it will be understood that if the initial centering of probe 54 is over the right end, the journal adjustment would be made at the left end. The procedure of FIG. 10 is repeated except the journal rest 138 or 140 at that end is moved toward the shorter probe. This will tell computer 116 if the journal rest 136 at that end needs to be adjusted (and how much). This adjustment can be made either manually by adjustment screw 140, or in a complete closed loop system via servo motors, similar to those already described for adjusting the sensor head. The contact probes will then all extend and computer 116 will compute the diameter of the roller and where the roller is on a 3 dimensional Cartesian coordinate system in space. The system will then take diameter measurements at preset intervals until the other end is again reached, and will move to the maximum diameter location. Probes 53–55 will then retract and probe 54 will extend, take a measurement and motor 20 will adjust the head 16 so that probe is exactly 0.0200" from the zenith of the roll. Then the noncontact sensor 66 will descend to the zenith of the roller, stopping approximately 0.02000" from the surface of the roller. The non-contact sensor will then be calibrated by taking readings at predetermined distances from the zenith of the roll. The non-contact sensor will then be placed 0.0200" from the roll. Solenoid 99 is then activated to allow air from air supply 91 to flow through the non-contact sensor 66 to clear working fluids. Coolant is turned on and the machining process will now begin. The non-contact sensor 66 will be in the same plane that the center of the grinding wheel is. With the information of the initial roller diameter, where the theoretical center of the roller is, and "knowing" the offset distance of the sensor is 0.02000" from the roller, the sensor will detect how much material is being removed from the roller as the roller surface "moves" away from the roller because of the grinding process. Thus, the computer 116 will always know during the machining process, the size of the roller (diameter), and the shape profile of the roller, while never touching the roller. The final roller profile is stored in memory, and a plot of the roller profile can be printed on paper along with any other pertinent information.

It will be appreciated that other materials or combinations thereof may be used to achieve similar results. The invention allows such modifications within the scope of the invention.

In view of the foregoing, it will be seen that the stated objects of the invention are achieved. The above description explains the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description shall be interpreted as illustrative rather than limiting. Thus, the breadth and scope of the present invention should not be limited by any of the above-described exemplary embodiments, but should be defined only in accordance with the following claims appended hereto and their equivalents.

All patents, if any, referenced herein are incorporated in their entirety for purposes of background information and additional enablement.

What is claimed is:

1. A non-contact gauging apparatus for precision machining of cylindrical workpieces, which comprises;

a sensor head having:

a pair of contact probes projecting from the body and movable in a radial direction, the probes having means for generating a signal indicative of the amount of movement of the probes in the radial direction relative to a rest position, a non-contact gauge for generating a signal indicative of the distance of the surface of the workpiece from a surface of the non-contact gauge without contacting the surface, a linear actuator for moving the non-contact gauge between a retracted rest position and an extended measuring position, and a vent in the sensor head adjacent the non-contact gauge and adapted to vent air to clear working fluids from between the non-contact gauge and the surface of the workpiece;

a sensor arm attached to and supporting said sensor head having:

a first means for moving the sensor head in precise distances in a radial direction relative to the cylindrical workpiece, a second means for moving the sensor head in precise distances in a tangential direction relative to the cylindrical workpiece, means for generating signals indicative of the distance the sensor head is moved by the sensor arm, and means for attachment of the sensor arm to a machining machine; and an longitudinal axis encoder adapted to be affixed to the machining machine and having means for generating a signal indicative of the magnitude of movements of the workpiece in the longitudinal axial direction by the machine.

2. The apparatus of claim 1, wherein the first and second means of the sensor arm are each a rail system connected to ball screws driven by a servo motor.

3. The apparatus of claim 1, wherein the first and second means of the sensor arm are each a rail system connected to ball screws driven by a stepper motor.

4. The apparatus of claim 1, wherein the contact probes are pneumatically extensible.

5. The apparatus of claim 1, further comprising a data entry device for entering approximate dimensions of the cylindrical workpiece.

6. The apparatus of claim 5, further comprising positioning means for locating the sensor head initially at an approximate position over the zenith of the cylindrical workpiece roll in response to approximate cylindrical workpiece dimensions entered into the entry device.

7. The apparatus of claim 1, wherein the longitudinal axis encoder further comprises a rack adapted to be attached to a longitudinally movable portion of the machine parallel to the longitudinal axis of the workpiece and a rotary encoder attached to the fixed portion of the machine.

8. The apparatus of claim 1, further comprising:

a computer to interpret the signals from the sensor head, sensor arm and encoder to calculate the position and diameter of the cylindrical object.

9. The apparatus of claim 1, wherein the non-contact gauge is a visible light reflectance measurement device.

10. The apparatus of claim 1, wherein the non-contact gauge is a microwave radiation measurement device.

* * * * *